US005617836A

United States Patent [19]

Cullen et al.

[11] Patent Number: 5,617,836

[45] Date of Patent: Apr. 8, 1997

[54] ENGINE CONTROL SYSTEM FOR PRODUCING AND RESPONDING TO AN INDEX OF MATURITY OF ADAPTIVE LEARING

[75] Inventors: Michael J. Cullen; Robert M. Marzonie, both of Northville; Alan R. Dona, Huntington Woods; Eric J. Grant, Royal Oak; Ronald A. Yannone, Clinton, all of Mich.

[73] Assignee: Ford Motor Company, Dearborn, Mich.

[21] Appl. No.: 538,928

[22] Filed: Oct. 4, 1995

[51] Int. Cl.[6] ..... F02D 41/14

[52] U.S. Cl. ..... 123/674; 123/486

[58] Field of Search ..... 123/478, 480, 123/674, 675, 486

[56] References Cited

U.S. PATENT DOCUMENTS

| | | | |
|---|---|---|---|
| 4,309,971 | 1/1982 | Chiesa et al. | 123/480 |
| 4,864,998 | 9/1989 | Onishi | 123/674 |
| 5,467,755 | 11/1995 | Konrad et al. | 123/674 |
| 5,485,821 | 1/1996 | Yoshizawa | 123/478 |

FOREIGN PATENT DOCUMENTS

| | | |
|---|---|---|
| 60-0190632 | 9/1985 | Japan . |
| 1-0190938 | 8/1989 | Japan . |
| 1-0190939 | 8/1989 | Japan . |
| 2-0027140 | 1/1990 | Japan . |

*Primary Examiner*—Tony M. Argenbright
*Attorney, Agent, or Firm*—Allan J. Lippa; Roger L. May

[57] ABSTRACT

An adaptive closed loop fuel control system generates an index of maturity value which indicates the extent to which parameters which characterize an individual engine have been learned and stored for future use in a non-volatile memory. A timer produces the index of maturity value by measuring the elapsed time during which the fuel control system has successfully operated the engine at or near stoichiometry within a predetermined range of engine speed and load conditions. A backup mechanism counts the number of HEGO sensor state changes as the closed loop controller operates in an adaptive mode, setting the index of maturity to a predetermined value even when the measured adaptation time fails to indicate an adequate amount of adaptive operation. The index of maturity value alters the mode of operation of the fuel control mechanism to provide robust rich operation prior to adaptation and a more aggressive lean mode operation after the adaptive parameters have been developed which permit optimized operation in the presence of air-to-fuel ratio production variability.

8 Claims, 2 Drawing Sheets

ENGINE CONTROL SYSTEM FOR PRODUCING AND RESPONDING TO AN INDEX OF MATURITY OF ADAPTIVE LEARING

FIELD OF THE INVENTION

This invention relates to electronic engine control systems and more particularly to fuel control systems which automatically adapt to manufacturing variations between vehicles and/or the changing operating characteristics of an engine over time.

BACKGROUND OF THE INVENTION

Conventional closed loop fuel control systems are responsive to the sensed level of oxygen in the combustion gases produced by the engine as measured by an exhaust gas oxygen sensor. The controller responds to a lean condition by progressively increasing the fuel delivery rate until a rich condition is detected, then decreases the fuel delivery rate until a lean indication appears, and so on. In this way, the closed loop controller can maintain the air/fuel mixture at or near stoichiometry to minimize undesirable combustion products.

The control system achieves the desired air/fuel ratio more rapidly when the open-loop portion of the system is able to accurately predict the needed air/fuel ratio based on sensed engine operating conditions (engine speed, load) etc. Adaptive control systems better achieve this accuracy while accommodating production variations in airflow measuring and fuel metering devices used in different engines, by storing parameters developed by the closed loop controller for future use. During subsequent engine operations, the previously generated and stored parameters are retrieved to enable the closed loop controller to more rapidly and more accurately achieve desired air/fuel ratios.

Highly effective fuel control strategies have been developed to help reduce engine emissions while maintaining acceptable engine performance. For example, during idling conditions when the engine is not required to do useful work other than driving accessory loads, fuel consumption and undesirable emissions may be minimized by adjusting the air/fuel ratio to an unusually lean mixture which still provides steady and reliable cylinder firing. The extent to which such strategies can be aggressively pursued with production vehicles is limited, however, by variations from vehicle to vehicle. Air/fuel calibration which would work well for the average vehicle is not chosen if it could impair driveability when used with some vehicles within the expected range of manufacturing tolerances.

SUMMARY OF THE INVENTION

It is an object of the present invention to improve the performance of a vehicle engine by modifying the engine control strategy in response to a generated "index of maturity" value.

The index of maturity value indicates the extent to which adaptively-controlled parameters have successfully been produced during normal engine operation and authorized the pursuit of more aggressive control strategies after the control system has successfully adapted to the engine's particular characteristics, while maintaining a less aggressive but more robust strategy to help insure acceptable performance prior to adaptation.

The present invention operates in conjunction with an electronic engine control (EEC) system in which one or more parameters are evolved, stored in a non-volatile memory, and subsequently used to optimize the operation of the engine. In accordance with the invention, means are employed for monitoring the operation of the adaptive control system to produce an "index of maturity" value which indicates the extent to which such parameters have been successfully generated. Thereafter, the mode of operation of the control system is selectively altered in response to the index of maturity value to help insure satisfactory performance prior to adaptation and optimized performance after adaptation.

In accordance with the invention, the index of maturity value varies from a first value established when the vehicle is first manufactured, or when the storage memory which saves the adaptively produced parameters has been erased or reset, to a second value established when the engine has been operated under predetermined operating conditions to allow the adaptive control mechanism to produced substantially optimized parameters for those conditions.

Means for detecting those engine conditions may be used to set the index of maturity value based on the measured duration of an interval during which adaptation occurs. Alternatively, means may be employed for counting events which occur during the adaptation period to set the index of maturity in accordance with the accumulated count. In the embodiment of the invention to be described, a two-valued index of maturity is initialized to a first value prior to adaptation, or when the adaptive parameter memory is cleared, and switched to a second value indicating that adaptation has occurred whenever a timer measures an adaptation interval longer than a predetermined duration. A backup mechanism is further employed to switch the index of maturity to the second value whenever a count of switching events created by the operating closed loop controller during adaptation exceeds a predetermined count, thus insuring that optimized values will be eventually used even when adaptation interval timer does not reach its threshold value.

As contemplated by the invention, the engine control system operates in a mode which is selected in part by the index of maturity value. In the preferred embodiment to be described, when the index of maturity value indicates that optimizing parameters are not yet available, the air/fuel control system operates in a first mode in which a rich air/fuel mixture is provided to the engine to insure sufficiently robust operation for engines having significantly different characteristics. When the index of maturity indicates that the closed loop system has "learned" parameters which insure optimized engine operation, a different, mode of control optimized for that engine is selected to provide a leaner air/fuel mixture which minimizes undesirable emissions and fuel consumption without degrading performance.

These and other objects, features and advantages of the invention may be more completely understood by considering the following detailed description of a preferred embodiment of the invention. In the course of this description, reference will frequently be made to the attached drawings.

DESCRIPTION OF THE PREFERRED EMBODIMENT

Figure 1:
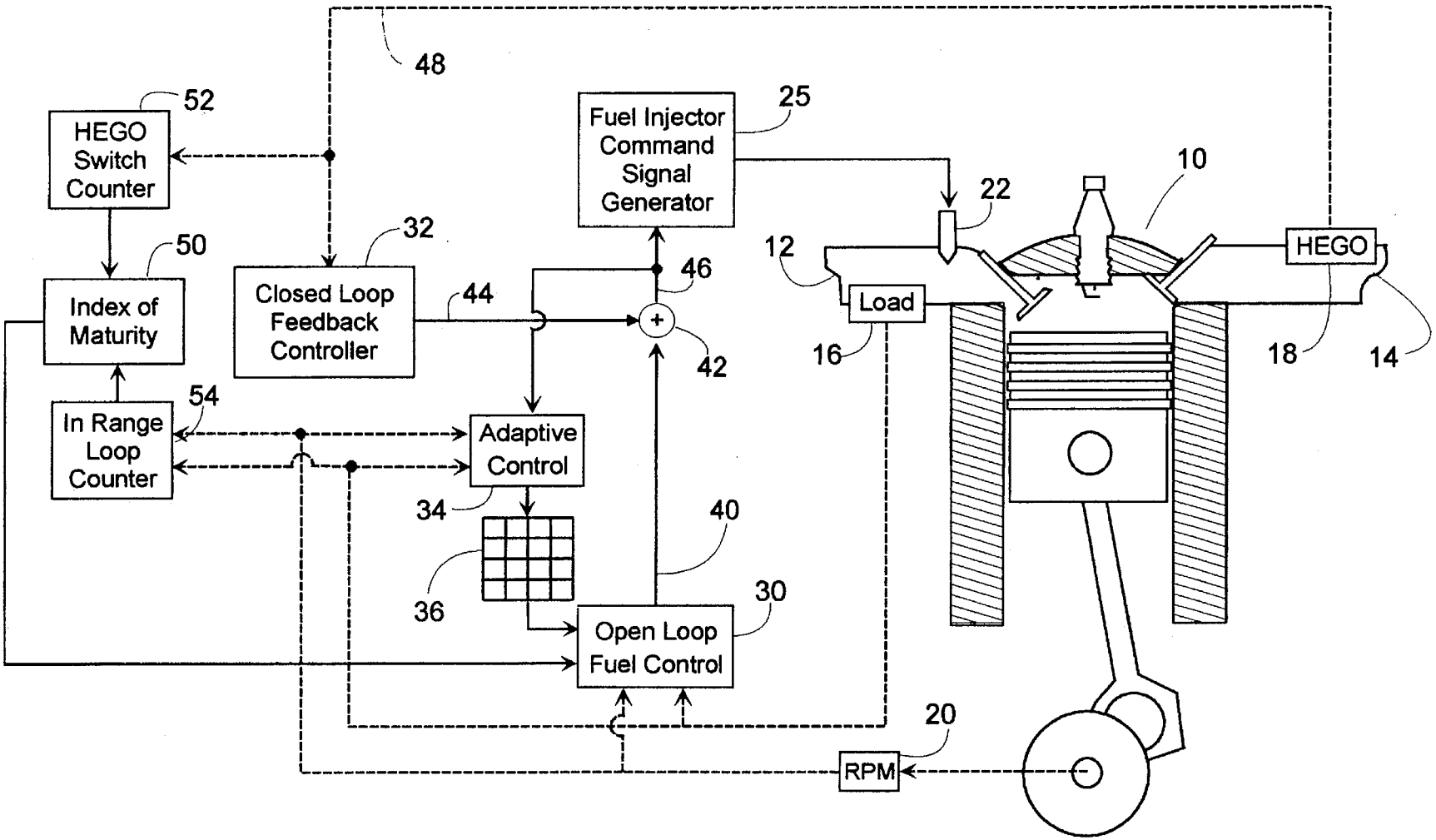
FIG. 1 is a schematic block diagram which illustrates the structure and operation of a preferred embodiment of the invention.
Figure 2:
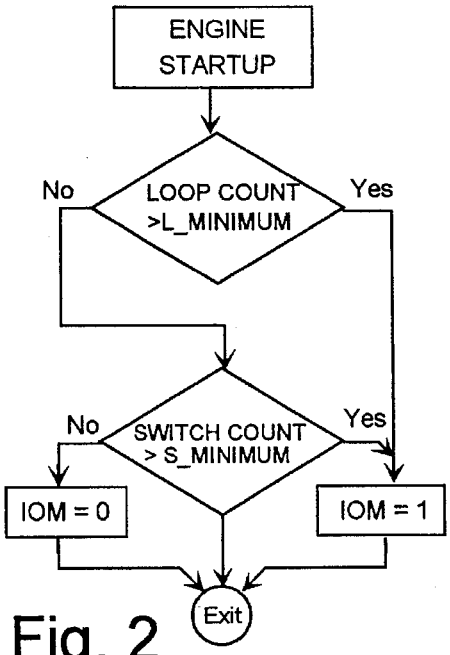
FIG. 2 is a flow chart illustrating the manner in which a two-valued index of maturity parameter is set in response to the current loop count and switch count values produced as shown in FIG. 3.
Figure 3:
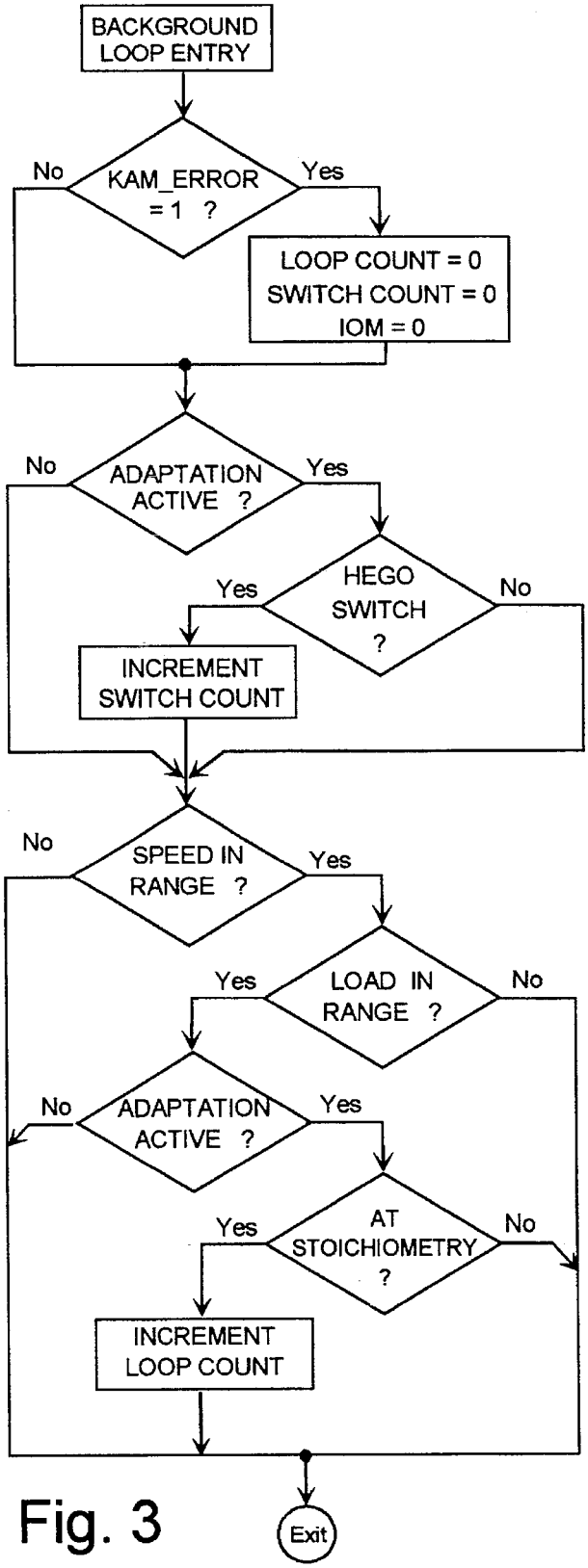
FIG. 3 is a flow chart which describes the manner of generating a loop count value which measures the duration of the time interval during which the engine is operating within a predetermined range of operating conditions; and a switch count value indicating the number of oxygen level changes exhibited by the HEGO sensor during adaptation.

FIGS. 1, 2 and 3 illustrate an adaptive fuel control system which employs the principles of the invention to reduce undesirable emissions under normal engine operating conditions while insuring that engines having significantly different operating characteristics will perform adequately, even before the engine control system's fuel control parameters are adaptively modified to compensate for manufacturing variations between vehicles.

As seen in FIG. 1, an engine indicated generally at 10 has an intake port 12 and an exhaust port 14. Sensing mechanisms which provide a set of input signal values indicating the current operating state of the engine include a load (mass air flow) sensor 16, a heated exhaust gas oxygen (HEGO) level sensor 18, and an engine speed (RPM) sensor 20.

The engine is further provided with fuel injector(s) as indicated at 22 which operate under the control of a fuel injector command signal generator 25. The fuel injector command signal generator 25 produces injection command signals having a duration which determines the amount of fuel injected into the engine and operates under the control of an open-loop fuel control unit 30, a closed-loop feedback control unit 32, and an adaptive control unit 34 which stores modifiable control parameters in a non-volatile "keep alive memory" (KAM) 36.

In operation, the open loop control unit 30 produces an output signal at 40 which is related to the estimated fuel delivery rate needed to achieve a desired air/fuel ratio under current engine speed and load conditions. The open loop control unit 30 operates in a conventional manner by retrieving parameter values from KAM 36 which correspond to the current engine speed and load conditions as indicated by the input signals from sensors 16 and 20. The mode of operation employed by the open loop control 30 is determined in part by an index of maturity value generated by a unit 50 in the manner described below.

The estimated fuel rate signal 40 produced by the open loop control 30 is then modified at 42 by a signal 44 produced by the closed loop feedback controller 32 to yield a corrected fuel rate control signal at 46 which is supplied to the command signal generator 25.

Controller 32 typically takes the form of a proportional-integral-differential (PID) feedback controller which is responsive to the exhaust oxygen level signal from the HEGO sensor. During normal engine operation, the closed loop controller 32 varies the magnitude of the signal 44 to progressively reduce the amount of fuel delivered to the engine whenever the HEGO sensor 18 indicates a rich condition, and varies the magnitude of the signal 44 in the opposite direction to progressively increase the fuel delivery rate whenever the HEGO sensor indicates a lean condition.

The closed loop controller 32 produces a fuel delivery rate which will achieve stoichiometry. The adaptive control unit 32 stores the value of the corrected fuel rate delivery signal 46 as a control parameter in the KAM 36 at memory locations indexed by the current load and engine RPM values from sensors 16 and 20. Thereafter, when the engine is again operated under given load and speed conditions, the adaptively stored parameter is read from the KAM memory and supplied to the open loop control unit 30 for use in generating an initial fuel rate value 40 which is then continuously modified at 42 by the closed loop feedback controller 32 in response to the state of HEGO sensor 18 to maintain stoichiometry.

An in-range loop counter 54 is employed to set the index of maturity value. The engine control mechanism seen in FIG. 1 is typically implemented by means of a programmed micro controller which performs the engine control functions schematically illustrated in FIG. 1 by executing programmed routines which are initiated at timed intervals. These adaptive control routines provide acceptable results when performed relatively infrequently as "background loop" processes executed by the EEC micro controller. The in-range loop counting mechanism seen at 54 increments a count value each time a micro controller background loop, when executed, determines that (1) the engine speed and load values are within predetermined ranges of interest and (2) the closed loop controller has achieved operation at or near stoichiometry. When the resulting in-range loop count reaches a predetermined threshold value, it is established that the engine has operated at or near stoichiometry within the defined operating range for a time duration sufficient to insure that learned fuel delivery rate values have been properly stored in the KAM 36 for that range of interest.

As the HEGO sensor 18 switches between lean and rich indications during adaptation, each change of state is counted by a HEGO switch counter 52. In the preferred embodiment of the invention as described below, the in-range loop counter 54 is normally employed to change the index of maturity value from its initial value to a value indicating that learned values are present in the KAM memory. The HEGO switch counter 52 is used as a backup mechanism which insures that the system will switch to a leaner mixture after sustained operation of the closed loop controller, even if the in-range loop counter 54 fails to reach its threshold count.

The operation of index of maturity generator 50 is illustrated by the flow chart in FIG. 2. At engine startup (and periodically thereafter), the engine control microprocessor tests the value LOOP COUNT at 60. If LOOP COUNT, which is produced by the loop counter seen at 54 in FIG. 1, is greater than a predetermined value L_MINIMUM, the index of maturity value IOM is set to 1. The IOM value is also set to 1 at 62 if the test performed at 64 indicates that the value SWITCH COUNT produced by the HEGO switch counter 52 is greater than the predetermined threshold quantity S_MINIMUM. IF neither LOOP COUNT nor SWITCH COUNT have reached their corresponding threshold counts, the IOM is set to zero at 66.

The values LOOP COUNT and SWITCH COUNT are produced as illustrated in FIG. 3. Each time the operative background loop routine is executed by the EEC micro controller, a flag value KAM_ERROR is first tested at 71. The KAM_ERROR flag is set to 1 whenever by the EEC when the vehicle is first assembled, at any time thereafter when KAM memory 36 is cleared by, for example, disconnecting the battery, or when a memory error detection mechanism (not shown) indicates that the stored data may have been corrupted. In response to this indication that the KAM memory does not hold adaptively learned values, the values LOOP COUNT, SWITCH COUNT and the index of maturity IOM are all reset to zero at 73.

Next, a test is performed at 81 to determine whether the engine speed falls within an range established by predetermined minimum and maximum RPM values. If the engine speed is within this established range, a test is performed at 83 to determine whether the current engine mass air flow rate (load) is within a range bounded by predetermined minimum and maximum values.

If the tests at 81 and 83 indicate that the engine is operating within the range of interest (e.g., is operating at "idle"), a test in made at 84 to determine if adaptation is active and, if so, a pair of tests 85 and 87 are performed in sequence.

The test at 85 determines whether or not the engine is operating at or near stoichiometry. This test determines whether the operation of the closed loop feedback controller 32 has successfully mapped values into the KAM 36 which enable the open loop controller 30 to produce a control signal 40 which yields operation near stoichiometric conditions. The successful mapping of parameters into the KAM 36 is indicated by comparing the average magnitude of the correction signal 44 from the feedback controller 32 with a predetermined value. If the open loop controller is operating within an established window about stoichiometry, the loop counter 54, which holds LOOP COUNT, is incremented at 86.

Because the background loop is executed by the EEC micro controller at regular intervals, the value of LOOP COUNT accordingly provides an indication of the length of time during which: (1) the engine has been operating within the speed and load range of interest; (2) when the fuel control system has been running in adaptation mode; and (3) the adaptive control unit 34 has learned and stored parameters in KAM 36 which enable the open loop control 30 to achieve operation at or near stoichiometry.

The test performed at 87 determines whether the HEGO sensor 18 has changed state (from rich to lean or vice versa) since the last test. If a state change has occurred, the value SWITCH COUNT is incremented by one at 89, otherwise the value of SWITCH COUNT remains unchanged. SWITCH COUNT accordingly stores the total number of HEGO state change events which have occurred during adaptation with the engine operating within the speed and load range of interest.

The index of maturity value IOM, which is set as illustrated in FIG. 2, is provided to the open loop control 30 may be used to alter the control strategy when successful adaptation is detected. By way of example, the open loop control unit may advantageously produced an output control signal, OLCS, during cold starting idle conditions using the relation:

$$OLCS=F1(Load,Temp,Tmr)+(IOM*F2(Load,Temp,Tmr))$$

where F1 and F2 are different table lookup functions of engine load, engine temperature, and the value Tmr which indicates the time elapsed since engine startup, with F1 providing a more robust rich fuel mixture and F2 providing additional enleanment in an amount determined by adaptively learned parameters, with the contribution by F2 being effective only when the index of maturity value IOM is non-zero. Although a two valued IOM value is employed in the illustrative preferred embodiment which has been described above, an IOM value which varies continuously between an initial value set before adaption starts and a final value indicating complete adaptation may be employed in connection with relations of the type noted above such that the amount control strategy is made progressively more aggressive as the index of maturity increases.

It is to be understood that the specific arrangement which has been described is merely illustrative on one application of the principles of the invention. Numerous modifications to the disclosed structures and methods may be made by those skilled in the art without departing from the true spirit and scope of the invention.

What is claimed is:

1. An electronic control system for controlling the operation of an internal combustion engine in response to varying engine operating conditions comprising:

sensing means for generating input signals having values representing said operating conditions, memory means for storing variable control parameters, control means for generating control signals having magnitudes determined jointly by said input signals and said control parameters, actuator means for controlling the operation of said engine in response to at least some of said control signals, adaptation means responsive to at least one of said input signals and at least one of said control signals for modifying a particular one of said variable control parameters toward an optimized value under a predetermined set of said engine operating conditions, means for counting events manifested by at least one of said input signals to form an accumulated event count value indicative of the extent to which said adaptation means has been operative, means responsive to said event count value for generating an index of maturity parameter, said index of maturity parameter having a value indicative of the extent to which said adaptation means has been operative to modify said particular control parameter toward said optimized value, and mode control means responsive to the value of said index of maturity parameter for altering the manner in which said control means generates said control signals.

2. An electronic control system as set forth in claim 1 wherein said means for generating said index of maturity parameter further includes means responsive to said input signals for detecting the existence of said predetermined set of operating conditions.

3. An electronic control system as set forth in claim 2 further including means for measuring the time duration during which the existence of said predetermined set of operating conditions is detected to form a condition duration value indicative of the extent to which said adaptation means has been operative.

4. An electronic control system as set forth in claim 1 including means for producing an initialization signal whenever the contents of said memory means are cleared and means responsive to said initialization signal for resetting said index of maturity parameter to a predetermined initial value.

5. An electronic fuel delivery control system for use with an internal combustion engine comprising:

sensing means for generating input signals having values indicative of the operating state of said engine including an oxygen level sensor for producing a two state signal indicative of the amount of oxygen in the exhaust from said engine, memory means for storing variable control parameters, closed loop control means jointly responsive to said input signals and to selected ones of said control parameters for modifying the rate at which fuel is supplied to said engine to achieve a desired air-to-fuel ratio, adaptive control means responsive to said closed loop control means for optimizing the value of said selected control parameters to more rapidly achieve said desired air-to-fuel ratio, means for generating an index of maturity value indicative of the extent to which said adaptive control means has been operative to optimize the value of said selected control parameters including means for counting changes in said two state signal to form an accumulated event count value indicative of the extent to which said adaptation means has been operative, and means for altering the mode of operation of said fuel delivery control system in response to changes in the value of said index of maturity value to control said air-to-fuel ratio.

6. An electronic fuel delivery system as set forth in claim 5 wherein said input signals include signals for indicating the current operating speed of said engine and the rate of air flow supplied to said engine, and wherein said means for generating said index of maturity value includes means responsive to said input signals for determining when said engine is operation with predetermined speed and air flow rate ranges.

7. An electronic fuel delivery system as set forth in claim 6 further including means for measuring the time duration during which the existence of said predetermined set of operating conditions is detected to form a condition duration value indicative of the extent to which said adaptation means has been operative.

8. An electronic control system as set forth in claim 5 including means for producing an initialization signal whenever the contents of said memory means are cleared and means responsive to said initialization signal for resetting said condition duration value, said event count and said index of maturity parameter to a predetermined initial value.

* * * * *